US007721527B2

(12) United States Patent
Brück et al.

(10) Patent No.: US 7,721,527 B2
(45) Date of Patent: May 25, 2010

(54) MULTI-LINE EXHAUST SYSTEM HAVING AT LEAST ONE MEASUREMENT SENSOR, HONEYCOMB BODY HAVING A RECESS FOR AT LEAST ONE MEASUREMENT SENSOR, AND METHOD FOR OPERATING A MULTI-LINE EXHAUST SYSTEM

(75) Inventors: Rolf Brück, Bergisch Gladbach (DE); Carsten Kruse, Lohmar (DE); Bernhard Pfalzgraf, Ingolstadt (DE)

(73) Assignees: EMITEC Gesellschaft fuer Emissionstechnologie mbH, Lohmar (DE); Audi AG, Ingolstadt (DE)

( * ) Notice: Subject to any disclaimer, the term of this patent is extended or adjusted under 35 U.S.C. 154(b) by 1270 days.

(21) Appl. No.: 11/226,845

(22) Filed: Sep. 14, 2005

(65) Prior Publication Data

US 2006/0039837 A1 Feb. 23, 2006

Related U.S. Application Data

(63) Continuation of application No. PCT/EP2004/002489, filed on Mar. 11, 2004.

(30) Foreign Application Priority Data

Mar. 14, 2003 (DE) ..... 103 11 235

(51) Int. Cl.
*F01N 3/00* (2006.01)

(52) U.S. Cl. ..... 60/276; 60/274; 60/302; 60/322; 60/323; 422/177; 422/180

(58) Field of Classification Search ..... 60/272, 60/274, 276, 302, 322, 323; 422/177, 180
See application file for complete search history.

(56) References Cited

U.S. PATENT DOCUMENTS 4,273,681 A 6/1981 Nonnenmann
4,534,213 A 8/1985 Mirikidani (Continued)

FOREIGN PATENT DOCUMENTS

DE 29 02 779 A1 7/1980

(Continued)

OTHER PUBLICATIONS

Japanese Office Action dated Dec. 24, 2008.

*Primary Examiner*—Binh Q. Tran
(74) *Attorney, Agent, or Firm*—Laurence A. Greenberg; Werner H. Stemer; Ralph E. Locher

(57) ABSTRACT

A multi-line exhaust system has at least two exhaust lines which are substantially separate from one another and at least one measurement sensor for measuring at least one characteristic variable of the exhaust gas. In which system, the at least one measurement sensor can be brought into contact with at least two exhaust lines. In such an exhaust system the measurement sensor determines at least one characteristic variable of the exhaust gas in two or more different exhaust lines, so that the outlay required to monitor the at least one characteristic variable in a plurality of exhaust lines can be significantly reduced compared to if a measurement sensor is formed in each exhaust line.

13 Claims, 2 Drawing Sheets

U.S. PATENT DOCUMENTS

| | | | | |
|---|---|---|---|---|
| 4,745,742 | A * | 5/1988 | Nada et al. | 60/276 |
| 4,832,998 | A | 5/1989 | Cyron | |
| 4,833,882 | A | 5/1989 | Yasuda et al. | |
| 5,045,403 | A | 9/1991 | Maus et al. | |
| 5,105,539 | A | 4/1992 | Maus et al. | |
| 5,157,010 | A | 10/1992 | Maus et al. | |
| 5,360,081 | A * | 11/1994 | Takegami | 180/309 |
| 5,845,490 | A | 12/1998 | Yasui et al. | |
| 5,976,473 | A | 11/1999 | Reck et al. | |
| 6,082,103 | A * | 7/2000 | Sugiura et al. | 60/323 |
| 6,190,784 | B1 | 2/2001 | Maus et al. | |
| 6,725,655 | B2 * | 4/2004 | Yoshirawa et al. | 60/323 |
| 6,925,862 | B2 * | 8/2005 | Fujita et al. | 73/114.73 |
| 6,962,049 | B2 * | 11/2005 | Ashida et al. | 60/323 |
| 7,454,901 | B2 * | 11/2008 | Kato et al. | 60/324 |
| 2004/0206067 | A1 | 10/2004 | Birkhofer et al. | |

FOREIGN PATENT DOCUMENTS

| | | | |
|---|---|---|---|
| DE | 88 16 154.4 | U1 | 3/1989 |
| DE | 197 55 126 | A1 | 7/1998 |
| DE | 101 24 550 | B4 | 12/2002 |
| EP | 0 245 737 | B1 | 11/1987 |
| EP | 0 835 366 | B1 | 4/1998 |
| FR | 2 586 753 | A1 | 3/1987 |
| JP | 57-28110 | U | 2/1982 |
| JP | 60-95117 | U | 6/1985 |
| JP | 2-135649 | U | 11/1990 |
| JP | 3-17161 | U | 2/1991 |
| JP | 07063092 | | 3/1995 |
| JP | 07116469 | | 5/1995 |
| JP | 09273440 | | 4/1996 |
| JP | 9-25841 | A | 1/1997 |
| JP | 11-280458 | A | 10/1999 |
| JP | 2002-266635 | A | 9/2002 |
| WO | 90/03220 | | 4/1990 |
| WO | 90/08249 | | 7/1990 |
| WO | 91/01178 | | 2/1991 |
| WO | 91/01807 | | 2/1991 |
| WO | 97/49905 | | 12/1997 |

* cited by examiner

MULTI-LINE EXHAUST SYSTEM HAVING AT LEAST ONE MEASUREMENT SENSOR, HONEYCOMB BODY HAVING A RECESS FOR AT LEAST ONE MEASUREMENT SENSOR, AND METHOD FOR OPERATING A MULTI-LINE EXHAUST SYSTEM

CROSS-REFERENCE TO RELATED APPLICATION

This is a continuation, under 35 U.S.C. §120, of copending international application No. PCT/EP2004/002489, filed Mar. 11, 2004, which designated the United States; this application also claims the priority, under 35 U.S.C. §119, of German patent application No. 103 11 235.9, filed Mar. 14, 2003; the prior applications are herewith incorporated by reference in their entirety.

BACKGROUND OF THE INVENTION

FIELD OF THE INVENTION

The present invention relates to a multi-line exhaust system having at least one measurement sensor, to a honeycomb body having recesses for at least one measurement sensor, and to a method for operating a multi-line exhaust system.

In many countries, the exhaust emissions from motor vehicles are presenting a problem for air quality, in particular in urban areas. In many countries, this has in recent years led to the stipulation of emission limits that the pollutant levels in the exhaust gas from motor vehicles may not exceed. These limits are complied with, inter alia, by the use of catalytic converters for converting pollutants. The emission limits are becoming ever more stringent, which results in that an increased outlay is required to convert the exhaust gas so as to increase the pollutant conversion rate. To reliably comply with the emission limits, it has become standard practice to determine characteristic values of the exhaust gas using measurement sensors, for example lambda sensors, temperature sensors or nitrogen oxide ($NO_x$) concentration sensors.

Predominantly, honeycomb bodies that have cavities that at least in part allow a fluid to flow through them are used as catalyst support bodies for converting the exhaust gas. These honeycomb bodies are predominantly produced from ceramic materials or metallic foils. A distinction is drawn in particular between two typical forms of metallic honeycomb bodies. An early form, of which published, non-prosecuted German patent application DE 29 02 779 A1 (corresponding to U.S. Pat. No. 4,273,681) shows typical examples, is the helical form, in which substantially one smooth sheet-metal layer and one corrugated sheet-metal layer are placed on top of one another and wound helically. In another form, the honeycomb body is built up from a multiplicity of alternately disposed smooth and corrugated or differently corrugated sheet-metal layers, with the sheet-metal layers initially forming one or more stacks which are intertwined. In the process, the ends of all the sheet-metal layers come to lie on the outer side and can be joined to a housing or tubular casing, forming numerous joints which increase the durability of the honeycomb body. Typical examples of these forms are described in European patent EP 0 245 737 B1 (corresponding to U.S. Pat. No. 4,832,998) or international patent disclosure WO 90/03220 (corresponding to U.S. Pat. No. 5,105,539). It has also long been known to equip the sheet-metal layers with additional structures in order to influence the flow and/or to realize cross-mixing between the individual flow passages.

Typical examples of configurations of this type are taught in international patent disclosures WO 91/01178, WO 91/01807 (corresponding to U.S. Pat. No. 5,045,403) and WO 90/08249 (corresponding to U.S. Pat. No. 5,157,010). Finally, there are also honeycomb bodies in conical form, if appropriate also with further additional structures for influencing the flow. A honeycomb body of this type is described, for example, in international patent disclosure WO 97/49905 (corresponding to U.S. Pat. No. 6,190,784). Furthermore, it is also known to form a cut-out for a sensor, in particular for accommodating a lambda sensor, in a honeycomb body. One such example is described in German utility model DE 88 16 154 U1.

In the case of multi-line exhaust systems, i.e. exhaust systems in which the exhaust gas, at least in partial regions of the exhaust system, is routed within at least two separate systems, either a honeycomb body of this type has to be formed in each of the exhaust lines, or a honeycomb body having a plurality of flow regions is introduced into the exhaust system in such a way that each individual flow region is connected to an exhaust line. In this context it is known, in particular from published, non-prosecuted German patent application DE 197 55 126 A1, to form a honeycomb body which has two flow regions which are concentric with respect to one another and are separated by an inner tube. European patent EP 0 835 366 B1 (corresponding to U.S. Pat. No. 5,976,473) proposes that the flow regions are not separated by additional structural measures, such as an inner tube, but rather to separate the flow regions by virtue of a partition interacting with an end side of the honeycomb body in such a way that it forms a seal with the walls of the cavities of the passage.

Stricter emission limits, in particular in connection with the OBD2 (onboard diagnosis 2) concept, may in particular make it necessary to determine characteristic variables of the exhaust gas upstream and downstream of an exhaust gas conversion, in particular upstream and downstream of a honeycomb body. In particular in the case of multi-line, for example two-line exhaust systems, this entails a high level of outlay, since in this case it is necessary to use not just two measurement sensors, but rather a multiplicity of measurement sensors, which in addition to a high outlay on design in particular also leads to high production and maintenance costs. Moreover, the susceptibility of the system to faults also increases with the number of measurement sensors.

SUMMARY OF THE INVENTION

It is accordingly an object of the invention to provide a multi-line exhaust system having at least one measurement sensor, a honeycomb body having a recess for at least one measurement sensor, and a method for operating a multi-line exhaust system which overcomes the above-mentioned disadvantages of the prior art devices and methods of this general type, which allows the monitoring of at least one characteristic variable of the exhaust gas in a plurality of exhaust lines with the minimum possible design outlay.

The multi-line exhaust system according to the invention has at least two exhaust lines which are substantially separate from one another and at least one measurement sensor for measuring at least one characteristic variable of the exhaust gas. It being possible for at least one measurement sensor to be brought into contact with at least two exhaust lines.

An exhaust system according to the invention advantageously allows one measurement sensor to be used to determine a characteristic variable in two or more exhaust lines. In a multi-line exhaust system, in each case one exhaust line is operating, i.e. being supplied with exhaust gas, at any specific instant. Consequently, there is not really any time in which exhaust gas is flowing into more than one exhaust line. On account of the time resolution of the measured values from the measurement sensor that can be connected to a plurality of exhaust lines, this fact allows the measurement data delivered by the measurement sensor to be accurately assigned to the corresponding exhaust line. This is possible in a simple way, since on the one hand it is known which exhaust line is being fed with exhaust gas at what times, and on the other hand is possible to determine how long the exhaust gas needs to pass from the internal combustion engine to the measurement point at which the measurement sensor picks up the data. Given a sufficiently good time resolution of the sensor, it is therefore possible for the measurement data from the measurement sensor to be assigned to one exhaust line. Consequently, just one measurement sensor at a measurement point can be used to determine a characteristic variable, such as for example the relative oxygen content, an $NO_x$ content, a hydrocarbon (HC) content, or also the temperature of the exhaust gas, in a plurality of exhaust lines, and consequently there is no need to incur the cost of forming further measurement sensors. Moreover, the exhaust system becomes simpler to produce, since fewer receiving parts for measurement sensors, which in any case represent potential sources of faults, for example with regard to the leak tightness of the system, have to be formed. Furthermore, the reliability is increased not only with regard to the leak tightness of the system but also by virtue of the fact that fewer measurement sensors have to be formed, and consequently the risk of a measurement sensor failing overall is reduced for the same quantity of data recorded by the measurement sensors.

According to an advantageous configuration of the exhaust system according to the invention, at least one honeycomb body has a first end face, a second end face and cavities which extend between the end faces and at least in part allow a fluid to flow through them is formed in the at least two exhaust lines. In this context, it is particularly preferable to form a honeycomb body having at least two flow regions which are closed off in an at least approximately gas tight manner with respect to one another, in which case at least a first flow region is connected to a first exhaust line and a second flow region is connected to a second exhaust line, and the exhaust lines are separated from one another by a first separating device and the flow regions are separated from one another by a second separating device.

This advantageously allows the catalytic conversion of pollutants in the exhaust gas in multi-line exhaust systems in a single honeycomb body that has various flow regions. This can be achieved, for example, by the second separating device being formed as additional components which pass through the whole of the honeycomb body in the axial direction and therefore ensure that the flow regions are separated. By way of example, it is possible to form concentric flow regions in which the second separating device forms a cylindrical intermediate tube. A further example is for a honeycomb body to be constructed from two semi-cylindrical half-shells, the flank of which is delimited by a wall. It is also possible for the flow regions to be separated without additional structural measures, for example by a suitable connection device interacting with the honeycomb body in the form of a labyrinth seal.

Furthermore, the second separating device may also contain the walls of the cavities themselves, if suitable connection device ensures that a type of labyrinth seal is formed. This can be ensured, for example, by forming a slot in the end face of the honeycomb body so as to interact with a corresponding connection device.

According to an advantageous configuration of the exhaust system, at least one measurement sensor is formed in the first separating device, preferably in the vicinity of an end face of the at least one honeycomb body.

The first separating device may, for example, contain a common wall, into which a measurement sensor has been introduced and which separates two or more exhaust lines. If just one honeycomb body is formed for a plurality of exhaust lines, it is advantageous for the at least one measurement sensor to be formed in the vicinity of an end face of the honeycomb body, since it is in this case possible to ensure without major structural outlay that the exhaust gas from a plurality of exhaust lines can be brought into contact with the measurement sensor.

According to a further advantageous configuration of the exhaust system according to the invention, at least one measurement sensor is formed in the second separating device, preferably in the vicinity of an end face of the at least one honeycomb body.

It is advantageous for at least one measurement sensor to be formed in the second separating device, since it is in this way easy for the measurement sensor to be brought into contact with the exhaust gas in a plurality of exhaust lines. Forming the at least one measurement sensor in the vicinity of an end face of the honeycomb body in this way can advantageously be used to determine a characteristic variable of the exhaust gas substantially before and/or after the catalytic conversion.

According to a further advantageous configuration of the exhaust system, the at least one measurement sensor is formed at a predeterminable minimum distance from an end face of the honeycomb body.

In particular if the characteristic variable to be determined is the concentration of a constituent of the exhaust gas that is to be stored in the honeycomb body, such as for example nitrogen oxide ($NO—_x$), it is advantageous to provide a predeterminable minimum distance between the at least one measurement sensor and an end face, in particular the end face on the gas outlet side, of the honeycomb body. If the minimum distance is selected appropriately, it is thus possible to ensure that this constituent does not break through the honeycomb body serving as a store even if the measurement sensor detects a predeterminable minimum concentration of the exhaust gas constituent.

According to a further advantageous configuration of the exhaust system according to the invention, at least one measurement sensor is a lambda sensor.

According to a further advantageous configuration of the exhaust system according to the invention, at least one measurement sensor is a nitrogen oxide ($NO_x$) concentration sensor.

According to a further advantageous configuration of the exhaust system according to the invention, at least one measurement sensor is a temperature sensor.

It is also possible for the types of measurement sensors mentioned above to be combined, so that, for example, a first measurement sensor is configured as a lambda sensor and a second measurement sensor is configured as a temperature sensor. It is also possible and within the scope of the invention to form combined measurement sensors that operate, for example, as a lambda sensor and at the same time determine the $NO_x$ concentration and/or the temperature. It is also possible and within the scope of the invention to form any other type of measurement sensor which determines a characteristic variable of the exhaust gas.

According to a further advantageous configuration of the exhaust system according to the invention, a first measurement sensor is formed in the first separating device upstream of the at least one honeycomb body, as seen in the direction of flow, or in the second separating device at a first distance from the first end face, and a second measurement sensor is formed in the first separating device downstream of the at least one honeycomb body as seen in the direction of flow, or in the second separating device at a second distance from the second end face.

According to a further aspect of the inventive concept, a honeycomb body has a first end face, a second end face and cavities which extend between the first end face and the second end face and at least in part allow a fluid to flow through them, in particular for use as a catalyst support body in a multi-line exhaust system of an internal combustion engine. A second separating device separates a first flow region from a second flow region of the honeycomb body. The honeycomb body is characterized in that at least one recess for a measurement sensor is formed in the region of the second separating device, so that both an exhaust gas which is flowing in the first flow region and an exhaust gas which is flowing in the second flow region come into contact with a measurement sensor that can be introduced into the recess.

According to an advantageous configuration of the honeycomb body according to the invention, at least one measurement sensor has been introduced into the at least one recess.

According to a further advantageous configuration of the honeycomb body according to the invention, the at least one measurement sensor is a lambda (λ) sensor, a nitrogen oxide ($NO_x$) concentration sensor and/or a temperature sensor.

It is particularly advantageous to form one or more measurement sensors that are combined λ sensors, $NO_x$ concentration sensors and/or temperature sensors. It is preferable for measurement sensors to be formed in corresponding recesses in the vicinity of the gas inlet side and in the vicinity of the gas outlet side.

A further aspect of the concept of the invention proposes a method for operating a multi-line exhaust system of an internal combustion engine using at least two measurement sensors for measuring at least one characteristic variable of the exhaust gas at in each case one measurement point, in which a characteristic variable of the exhaust gas in at least two exhaust lines is measured using at least one measurement sensor.

According to a further advantageous configuration of the method according to the invention, the oxygen/fuel ratio, the nitrogen oxide content and/or the temperature of the exhaust gas is determined.

According to a further advantageous configuration of the method, the measurement data of the measurement sensors are assigned to an exhaust line on the basis of the operating data of the internal combustion engine and the state data of the exhaust system.

The ignition times of those cylinders from which the exhaust gas is passed into a defined exhaust line can be determined in a simple manner from the operating data of the internal combustion engine, so that consequently it is known which exhaust line has exhaust gas flowing through it at what times. The time which it takes for the exhaust gas to reach the measurement sensor, and therefore also the time at which the exhaust gas in a defined exhaust line is in contact with the measurement sensor, can be determined from the state data of the exhaust system, for example length and shape of the exhaust lines and the corresponding operating data of the internal combustion engine, so that the data recorded by the measurement sensor can be assigned to this exhaust line. In this case, the abovementioned time that it takes for the exhaust gas to reach the measurement sensors can be determined empirically or analytically. It is thus possible in a simple way for a measurement sensor to be used to determine a characteristic variable of the exhaust gas in two or more exhaust lines.

All the advantages which have been described for the exhaust system according to the invention equally apply to the honeycomb body according to the invention and the method according to the invention, and vice versa.

Other features which are considered as characteristic for the invention are set forth in the appended claims.

Although the invention is illustrated and described herein as embodied in a multi-line exhaust system having at least one measurement sensor, a honeycomb body having a recess for at least one measurement sensor, and a method for operating a multi-line exhaust system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
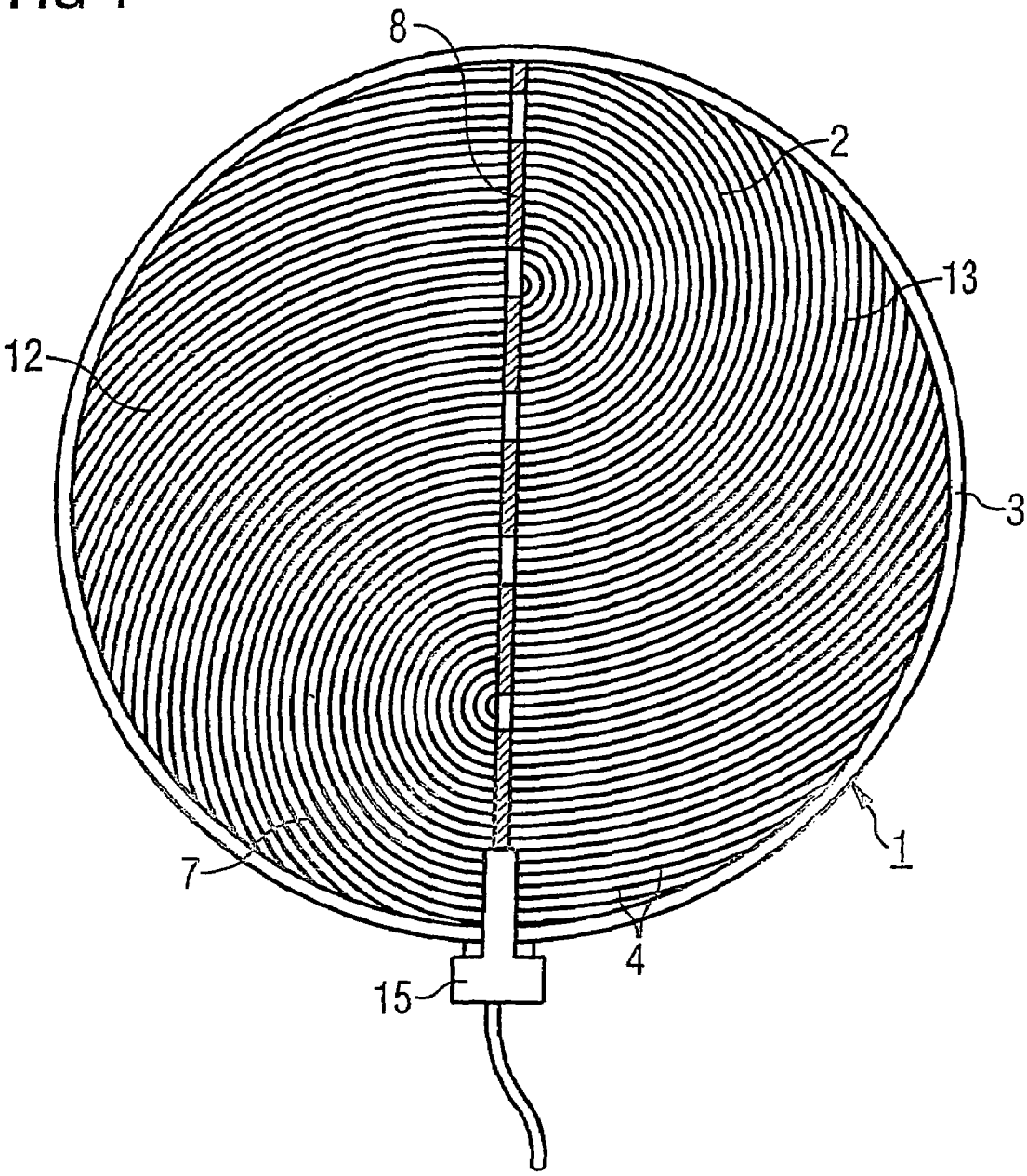
FIG. 1 is a diagrammatic, end-side view of a honeycomb body according to the invention.
Figure 2:
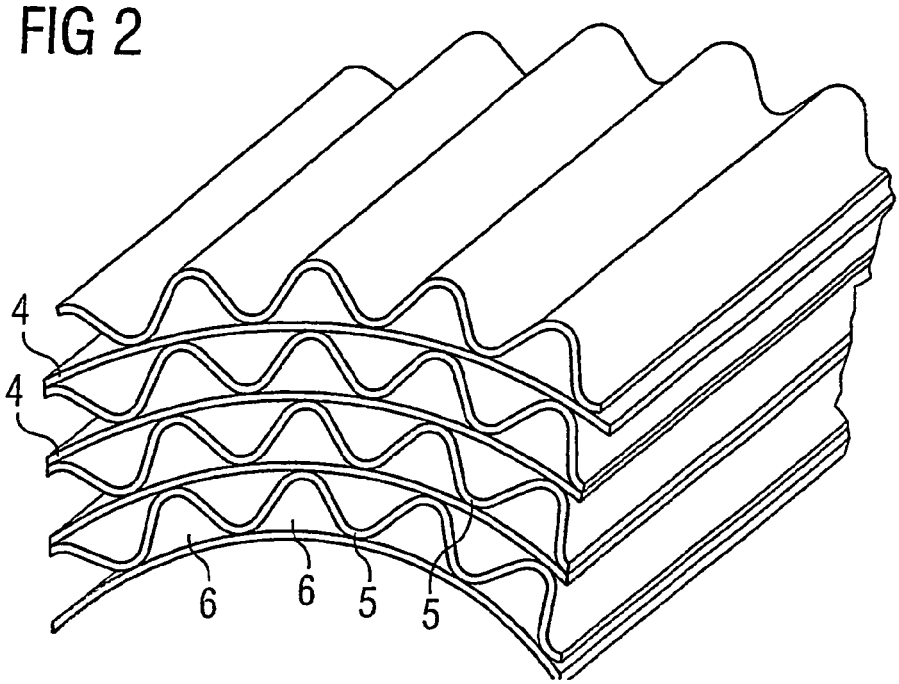
FIG. 2 is a diagrammatic, perspective view of an excerpt from the honeycomb body.

Referring now to the FIGS. of the drawing in detail and first, particularly, to FIG. 1 thereof, there is shown an end-side view of a honeycomb body 1 according to the invention. The honeycomb body 1 contains a honeycomb structure 2 that is secured in a tubular casing 3. The honeycomb structure 2 is built up from substantially smooth sheet-metal layers 4 and structured sheet-metal layers 5, which form passages 6 through which an exhaust gas can flow, as shown in detail in FIG. 2. The structured sheet-metal layers 5 are not shown in FIG. 1, for the sake of clarity.

In the present exemplary embodiment, the honeycomb structure 2 is formed by alternately stacking smooth sheet-metal layers 4 and structured sheet-metal layers 5 and then intertwining two stacks in the same direction. However, any other form of a metallic or ceramic honeycomb body 1 is also possible and within the scope of the invention.

A first part 8 of a first separating device 9, which separates two exhaust lines 10, 11 from one another, is fitted to a first end face 7 of the honeycomb body 1. The exhaust gas from defined cylinders of an internal combustion engine is passed through each of the exhaust lines 10, 11. In this exemplary embodiment, the first part 8 is configured as a metal sheet which bears against the end face 7. The honeycomb body 1 is divided into a first flow region 12 and a second flow region 13, which form part of different exhaust lines 10, 11 of an exhaust system. The two flow regions 12, 13 are separated by a second separating device 14, which in the present exemplary embodiment are formed by the walls of the passages 6 which are formed by the smooth sheet-metal layers 4 and the structured sheet-metal layers 5 and lie downstream of the first part 8 of the first separating device 9. Since the first part 8 is not entirely congruent with the walls of the corresponding passages 6, slight leaks may occur between the first flow region 12 and the second flow region 13, but these leaks are insignificant, since the exhaust gas is converted in both flow regions 12, 13, and consequently there is no loss of unconverted exhaust gas, i.e. undesirable pollutant emissions. To increase the leak tightness, the first end face 7 can be slotted in such a way that, by interacting with the first part 8 of the first separating device 9, which engages therein, a type of labyrinth seal is formed.

Figure 3:
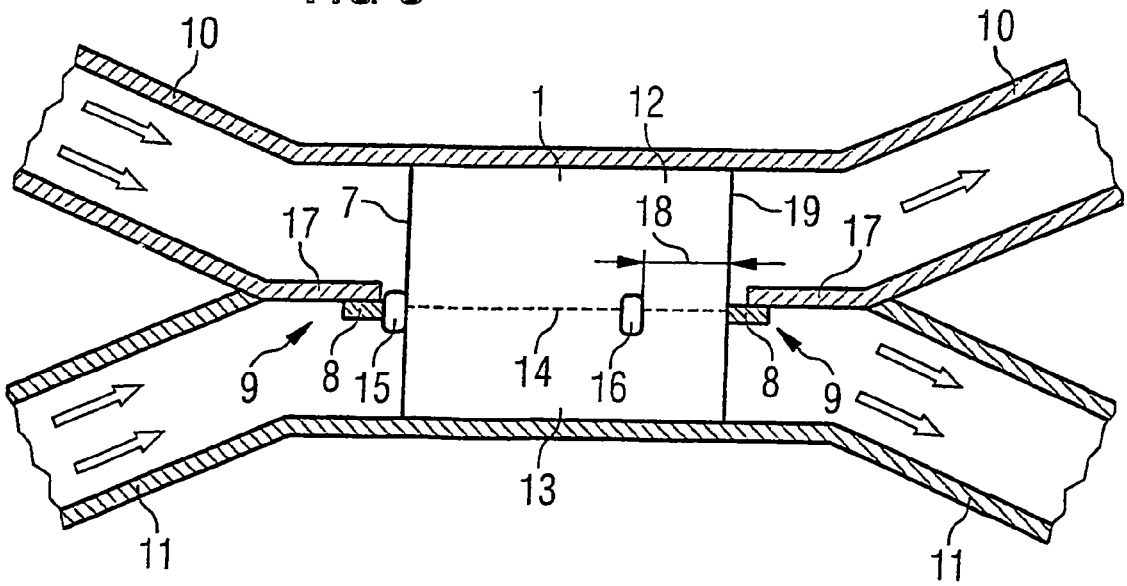
FIG. 3 is a diagrammatic, sectional view through an exhaust system according to the invention.

A first measurement sensor 15, which is located axially upstream of the first end face 7 of the honeycomb body 1, as can be seen from FIG. 3, and therefore upstream of the honeycomb body 1, is formed within the first part 8 of the first separating device 9. The first measurement sensor 15 is therefore in contact both with exhaust gas which flows within the first exhaust line 10 and with exhaust gas which flows within the second exhaust line 11, so that just one measurement sensor 15 can be used to determine a characteristic variable of the exhaust gas in a plurality of exhaust lines 10, 11 prior to catalytic conversion in the honeycomb body 1.

The measurement data delivered by the measurement sensor 15 are assigned to the exhaust lines 10, 11, for example, by virtue of the fact that it is known which exhaust line 10, 11 is being supplied with exhaust gas at what time. The operating data of the internal combustion engine can also be used to determine the mean flow rate at which the exhaust gas is flowing through the respective exhaust line 10, 11. Since the length and geometry of the exhaust lines 10, 11 are known, however, the instant at which the first measurement sensor 15 picks up data can easily be correlated with the time which it takes for the exhaust gas to reach the measurement point at which the first measurement sensor 15 picks up the data, so that in this way it is also known which of the exhaust lines 10, 11 the data of the first measurement sensor 15 can be assigned to at a specific instant.

Furthermore, as shown in FIG. 3, there is at least one second measurement sensor 16, which in the present exemplary embodiment is formed within the second separating device 14. The second separating device 14 is merely indicated as a dashed line, in order to show that in the present exemplary embodiment the second separating device 14 does not contain an additional, separate component, but rather is formed from the walls of the passages 6 located downstream or between the first parts 8 of the first separating device 9. However, it is equally possible for second separating device 14 to be formed as an additional component, for example as a partition or separating tube if the flow regions 12, 13 are disposed concentrically, and these options are likewise within the scope of the invention. In this context, it should be noted that in the case of a concentric second separating device, the at least one measurement sensor 15, 16 also has an annular cross section.

The second measurement sensor 16 can pick up data both from the first flow region 12, which is part of the first exhaust line 10, and from the second flow region 13, which is part of the second exhaust line 11. The data from the second measurement sensor 16 can be assigned to the exhaust line 10, 11 in the same way as what has been outlined above in connection with the first measurement sensor 15, although it is also possible to employ further components, such as for example flow sensors or the like, to assign the data from the two measurement sensors 15, 16 to the exhaust lines 10, 11.

In this exemplary embodiment, the first measurement sensor 15 is formed in the first separating device 9 and the second measurement sensor 16 is formed in the second separating device 14. It is equally possible and within the scope of the invention for both measurement sensors 15, 16 to be formed in the first separating device 9 or the second separating device 14, or for the first measurement sensor 15 to be formed in the second separating device 14 and the second measurement sensor 16 to be formed in the first separating device 9. If the measurement sensor(s) 15, 16 is/are formed in the first separating device 9, it is irrelevant whether it/they is/are formed in the first part 8 or in a partition 17 between the exhaust lines 10, 11.

The measurement sensors 15, 16 may, for example, be lambda (λ) sensors, temperature sensors and/or nitrogen oxide ($NO_x$) concentration sensors. Each of the measurement sensors 15, 16 may also form a combination of these and/or other sensors.

Depending on the particular application, it may be necessary for the honeycomb body 1 to be configured as a store for one or more constituents of the exhaust gas, for example as a $NO_{-x-}$ store which can be regenerated. In particular in this case, it may be advantageous for the second measurement sensor 16 to be formed at a predeterminable minimum distance 18 from the second, gas-outlet-side, end face 19. In this case, regeneration of the $NO_{-x-}$ store can be initiated in the event of a minimum concentration being exceeded at the second measurement sensor 16 without $NO_{-x}$ already having escaped through the second end face 19 of the honeycomb body 1.

An exhaust system according to the invention has at least one measurement sensor 15, 16 for determining at least one characteristic variable of the exhaust gas in two or more different exhaust lines 10, 11, so that the configuration outlay required to monitor the at least one characteristic variable in a plurality of exhaust lines 10, 11 can be significantly reduced compared to a measurement sensor 15, 16 being formed in each exhaust line 10, 11.

We claim:

1. A multi-line exhaust system, comprising:

at least two first and second exhaust lines substantially separate from one another;

at least one measurement sensor for measuring at least one characteristic variable of an exhaust gas, said measurement sensor being brought into contact with exhaust gas flowing within said at least two exhaust lines:

at least one honeycomb body formed in said at least two exhaust lines, said at least one honeycomb body having a first end face, a second end face, and cavities formed therein, said cavities extending between said first and second end faces and at least partially allowing a fluid to flow through, and said at least one honeycomb body having at least two first and second flow regions closed off in an approximately gastight manner with respect to one another, said first and second flow regions each connected to a respective one of said first and second exhaust lines;

a first separation device separating said first and second exhaust lines from one another and preventing exhaust gas guided by said first exhaust line from mixing with exhaust gas guided by said second exhaust line until the exhaust gases enter said at least one honeycomb body; and a second separation device separating said flow regions from one another.

2. The exhaust system according to claim 1, wherein said measurement sensor is formed in said first separating device.

3. The exhaust system according to claim 1, wherein said measurement sensor is formed in said second separating device.

4. The exhaust system according to claim 3, wherein said measurement sensor is formed at a predeterminable minimum distance from one of said first and second end faces of said honeycomb body.

5. The exhaust system according to claim 1, wherein said measurement sensor is a lambda sensor.

6. The exhaust system according to claim 1, wherein said measurement sensor is a nitrogen oxide ($NO_x$) concentration sensor.

7. The exhaust system according to claim 1, wherein said measurement sensor is a temperature sensor.

8. The exhaust system according to claim 1, wherein said measurement sensor includes a first measurement sensor formed in said first separating device upstream of said honeycomb body, as seen in a direction of flow, or in said second separating device at a first distance from said first end face, and a second measurement sensor formed in said first separating device downstream of said honeycomb body, as seen in the direction of flow, or in said second separating device at a second distance from said second end face.

9. The exhaust system according to claim 2, wherein said measurement sensor is formed in said first separating device in a vicinity of one of said first and second end faces of said honeycomb body.

10. The exhaust system according to claim 3, wherein said measurement sensor is formed in said second separating device in a vicinity of one of said first and second end faces of said honeycomb body.

11. A honeycomb body for use as a catalyst support body in a multi-line exhaust system of an internal combustion engine, the honeycomb body comprising:

a first end face;

a second end face;

cavities formed therein extending between said first end face and said second end face and at least in part allow a fluid to flow through, said cavities defining a first flow region and a second flow region; and a separating device disposed inside the honeycomb body for separating said first flow region from said second flow region, said separating device having at least one recess formed therein for receiving a measurement sensor, so that both an exhaust gas flowing in said first flow region and an exhaust gas flowing in said second flow region would come into contact with the measurement sensor.

12. The honeycomb body according to claim 11, further comprising a measurement sensor disposed in said recess.

13. The honeycomb body according to claim 12, wherein said measurement sensor is selected from the group consisting of lambda ($\lambda$) sensors, nitrogen oxide ($NO_x$) concentration sensors and temperature sensors.

* * * * *